United States Patent [19]

Inoue et al.

[11] 4,142,829

[45] Mar. 6, 1979

[54] COMPOUND REMOTE CONTROL DEVICE FOR THE PROPULSION ENGINE OF A SHIP'S VARIABLE-PITCH PROPELLER

[75] Inventors: Hiroo Inoue, Amagasaki; Makoto Takagi, Kobe, both of Japan

[73] Assignee: The Nippon Air Brake Co., Ltd., Kobe, Japan

[21] Appl. No.: 762,977

[22] Filed: Jan. 27, 1977

[51] Int. Cl.[2] ..... B63H 3/10

[52] U.S. Cl. ..... 416/25; 416/27

[58] Field of Search ..... 416/25, 27

[56] References Cited

U.S. PATENT DOCUMENTS

| | | | |
|---|---|---|---|
| 2,958,381 | 11/1960 | Stevens | 416/27 |
| 3,302,724 | 2/1967 | Brooks | 416/27 |
| 3,826,590 | 7/1974 | Kobelt | 416/27 |

*Primary Examiner*—Everette A. Powell, Jr.

*Attorney, Agent, or Firm*—R. W. McIntire, Jr.

[57] ABSTRACT

The present invention relates to a compound remote control device for controlling the pitch of a variable-pitch propeller on a ship's drive mechanism while at the same time controlling the speed of the ship's engine, and provides a control mechanism for compound control under various control conditions, whereby the conventional equipment being of a complex structure using 2 cams, is simplified by using one cam and a pressure-control valve cooperating therewith. With said control device, control of the speed of the aforesaid engine and the control of the pitch of the variable-pitch propeller are carried out by using air-pressure signals under various control conditions, that is, where the relationship of the various control air pressures in relation to the position of the control lever varies as for example shown in FIG. 1.

1 Claim, 4 Drawing Figures

COMPOUND REMOTE CONTROL DEVICE FOR THE PROPULSION ENGINE OF A SHIP'S VARIABLE-PITCH PROPELLER

Figure 1:
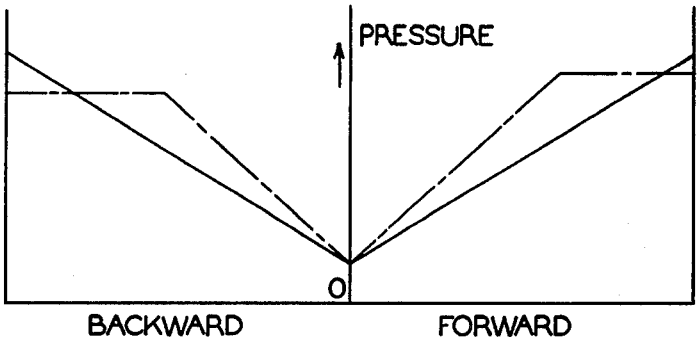
FIG. 1 is a diagram showing the relationship between the control lever position and the control pressure for the pitch of the variable-pitch propeller and the control pressure for the engine speed, as controlled by the compound remote control device of the present invention.

In FIG. 1 of the drawing, the vertical axis indicates the control air pressure while, on the horizontal axis, the right-hand side of the origin indicates the control lever position for forward ship motion and the left-hand side indicates the lever position for backward ship motion. The solid lines in the figure indicate the relationship between the engine speed-control air pressure and the lever position, the broken lines indicating the relationship between the control air pressure for the pitch of the variable-pitch propeller and the lever position. The angles of slope of the two lines are different and the pitch control air pressure is constant at a certain limiting value. Thus, in one and the same control lever position, the two control pressures are not equal but are mutually displaced by a fixed amount. Hence, control by two differing air pressures takes place by means of one control lever, while there is no need to regulate two air-pressure control valves using two different cams.

Figure 2:
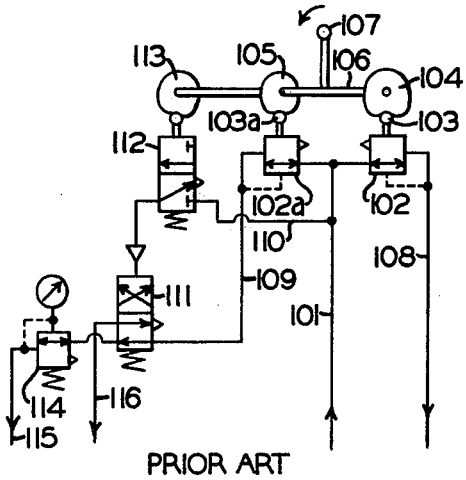
FIG. 2 is a diagram of a prior art conventional device.

Referring now to FIG. 2 of the drawing, there is shown a diagram illustrating the main features of a conventional remote control device using the above-indicated method. In this figure, the numeral 101 indicates an air pipe leading from a compressed-air source, the numerals 102 and **102*a* indicate pressure-control valves connected to said pipe, the numerals 103 and 103*a* indicate cam rollers on the ends of the valve rods of the pressure-control valves, and the numerals 104 and 105 indicate cams of different shape, each touching one of the two cam rollers. The cams 104 and 105 are interconnected by means of a connecting rod 106, there being a control lever 107 attached to said connecting rod 106**.

When the control lever 107 is turned in the direction indicated by the arrow, the aforesaid cams 104 and 105 press down the valve rods of the pressure-control valves 102 and **102*a*, the pressure of the compressed air, supplied at a fixed pressure and flowing through the pipe 101, then drops under the changed condition, and is discharged via the pipes 108 and 109. As the angle of rotation of the lever is increased, the air pressure in the pipes 108 and 109 rises in accordance with the shape of the cams 104 and 105. Pipe 108 is connected to the engine governor and the compressed air discharged into it controls the speed of rotation of the engine. The pipe 109** is connected to the variable-pitch device controlling the pitch.

There is a cam 113 which actuates a pilot valve 112 to which is connected the inlet pipe 110 of said pilot valve 112 and the switch valve 111 of the pilot valve 112, said switch valve being provided in order to be able to switch to either the pipe 115 transmitting the air-pressure signal for forward rotation or to the pipe 116 for backward motion. According to the direction of movement of the control lever 107, the variable-pitch propeller device is caused to operate for forward or backward motion.

When the control lever is turned in a direction opposite to that indicated by the arrow in the figure, the signalling air pressure for backward motion is transmitted via the pipe 116.

In the case of the above-indicated conventional type of remote control device, two cams of different shape and two pressure-control valves are required. When the slope and initial start point of the two control air-pressure lines in the figure are changed, the cam shapes must be changed as well, and it is difficult to effect the regulation in such a way as to obtain an optimal relationship between the engine speed and the variable pitch.

The object of the present invention is to solve the aforementioned problems by providing a compound remote control device which combines one cam and a pressure-control valve controlled thereby for controlling the air pressure with a relay operator valve for changing the pressure by a predetermined proportion, while providing at the same time a simplified structure.

We will now describe the structure and operation of the present invention with reference to a practical embodiment.

Figure 3:
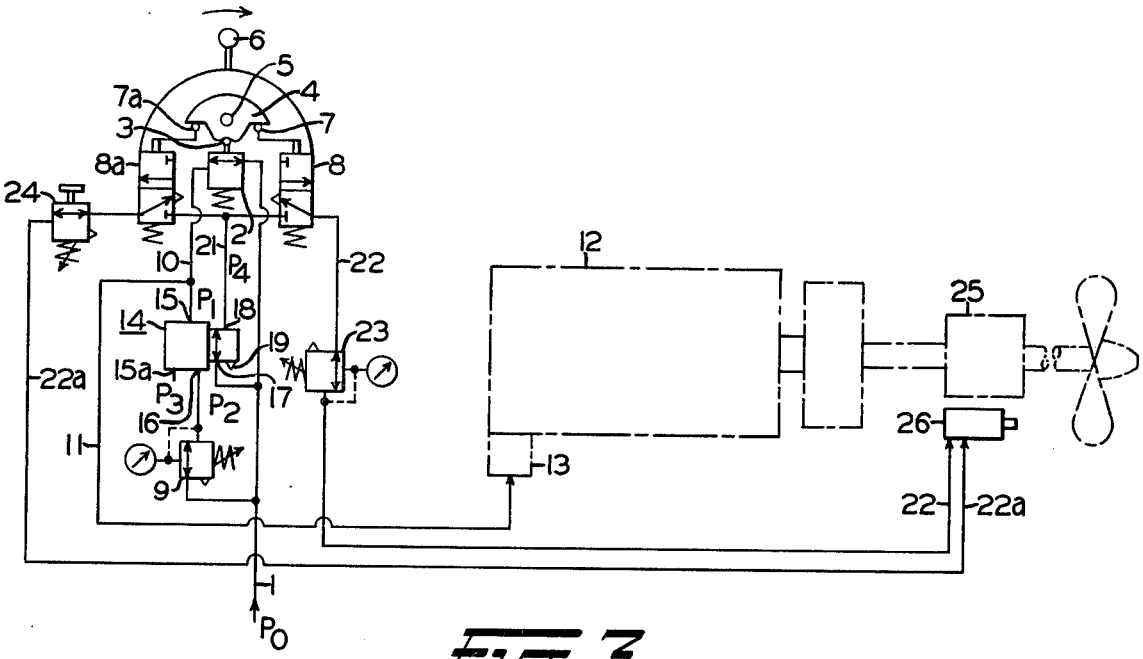
FIG. 3 is a diagram of a practical embodiment according to the present invention.

FIG. 3 shows a diagram of the entire remote control device disclosing the present invention. In this figure, the numeral 1 indicates a pipe supplying air at a fixed pressure, connected to a compressed-air source. The numeral 2 indicates a pressure-control valve which regulates the pressure of the compressed air, supplied through the pipe 1, in accordance with the position of the control lever, and delivers it to the pipe 10. The cam roller 3 at the end of the valve rod touches a single cam 4. At the center of cam 4, there is provided a shaft 5 which can be turned to the left or right by means of the control lever 6. When turned in one direction (for example in the direction of the arrow, i.e. to the right) the variable-pitch propeller is controlled for forward movement. When turned in the other direction (for example to the left), the control for backward motion is effected. The numerals 8 and **8*a* indicate switch valves for the aforesaid forward and backward motions, respectively. The cam rollers 7 and 7*a* connected with the valve rods of the aforesaid valves touch the aforesaid cam 4. Hence, when the control lever 6 is turned to the right, the cam 4 depresses the cam roller 3, thus operating the valve rod of the pressure-control valve 2, and the pressure-controlled air, as shown by the solid line in FIG. 1, is delivered as an output pressure to the pipe 10. The pipe 11 branches off from pipe 10 and leads to the speed governor 13 of the engine 12. The pipe 10 also leads to the inlet 15 of the relay operator valve 14. The outlet 18 of said relay operator valve 14 is connected, via the pipe 21, with inlets of the aforesaid switch valves 8 and 8*a*. The outlets of the switch valves 8 and 8*a* are connected with the controller 26 of the variable-pitch device 25 via the pipes 22 and 22*a* and the pressure-control valves 23 and 24. The pressure-control valves 23 and 24 serve to prevent the control air pressure from exceeding the prefixed pressure, as indicated by the broken lines in FIG. 1. In addition to the inlet 15 and the outlet 18, the relay operator valve 14 has a port 17 through which it is connected with the compressed-air source. The pressure of the compressed-air source is reduced to the fixed pressure by means of the pressure-reducing valve 9, said pressure-reduced air being supplied at port 16. Furthermore, there is also provided an inlet 15***a* and an air exhaust port 19. Now, the air pressure coming from the pressure-control valve 2 and entering at the inlet 15 will be referred to as P1, the air pressure supplied to the aforesaid port 16 as P2, the air pressure delivered to the supply port 17 as Po and the pressure of the air discharged from the outlet 18 as P4. Also, the opening 15*a* as shown in the figure is open to the atmosphere, but when there is a separate inlet its air pressure is indicated by P3, and the result then is the equation $P4 = P2 + K (P1 - P3)$.

Figure 4:
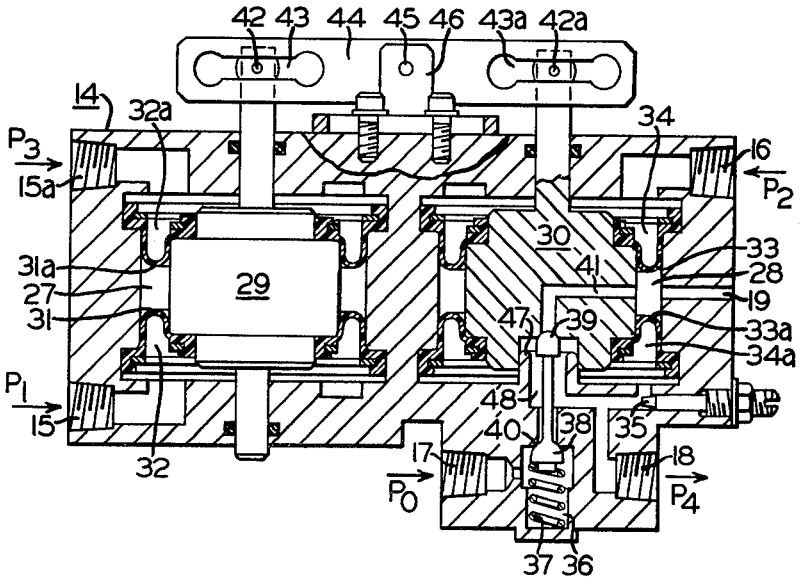
FIG. 4 shows a cross-sectional view of the relay operator valve 14 shown in FIG. 3.

FIG. 4 is a cross-sectional diagram of an example of the aforesaid relay operator valve 14 and will serve to explain how the aforesaid equation is formed. Said relay operator valve comprises two chambers 27 and 28, arranged in parallel, with pistons 29 and 30. Extensions of the two pistons are connected by a lever 44. Further, there are provided the supply and exhaust valves 38 and 39. In the aforementioned chamber 27, there are located two diaphragms 31 and 31*a*. As shown in the figure, the centers of these diaphragms are attached to the piston 29 which can freely perform an up and down stroke, via the valve body wall. Said diaphragms 31 and 31*a* divide the valve chamber into a chamber 32 communicating with the inlet 15, a central chamber 27 and a chamber 32*a* communicating with the inlet 15*a*. According to the difference in compression of the air pressures in the chambers 32 and 32*a*, the piston 29 moves up or down. In the same way the chamber 28 is divided by the diaphragms 33 and 33*a* and the piston 30, into a chamber 34 which communicates with port 16, a central chamber 28 and a chamber 34*a* which via a throttle 35 communicates with outlet 18. The lower end of the piston 30 fits over the outer perimeter of a tubular body 47 provided on the bottom wall of the valve. The chamber 48 formed by the hole inside the aforesaid tubular body 47 is connected to the outlet 18. Below the chamber 48, there is provided a spring chamber 36 connected with the supply port 17. In the dividing wall between the two chambers, there is a hole through which the valve rod of the supply valve 38 passes in a slidable relation, a clearance space being provided. Between the supply valve 38 and the bottom of the spring chamber, there extends a spring 37. Normally, it exerts an upward pressure without there being a downwardly directed force exerting pressure upon the valve, and said valve sits on the valve seat 40 of the aforesaid hole in the dividing wall. When a downwardly directed force is exerted on the valve and this force overcomes the force of the spring 37, the valve is separated from its seat, thus connecting the supply port 17 with the chamber 48 via the spring chamber 36, and an air pressure corresponding to the aforesaid downwardly directed force is transmitted to the outlet 18. Furthermore, the exhaust valve 39 provided at the other end of the valve rod is located opposite the seat of the inlet of the passage 41 in the piston 30. When the piston moves downward, the inlet opening is tightly closed, whereas when the piston 30 rises, it is opened, thus connecting the chamber 48 with the outlet 19 via the passage 41 and the central chamber 28. The upward extensions of said pistons 29 and 30 engage with the longitudinal holes 43 and 43*a* in the lever 44 by means of the pins 42 and 42*a*, the position of engagement being freely variable in accordance with a rightward or leftward movement of the lever 44. At the center of the lever 44, there is provided a pin 45 which is freely rotatably inserted in the support member 46. The lever 44 pivots about the central pin 45 in accordance with the upward and downward movement of the piston 29, thus causing the piston 30 to perform a stroke. Furthermore, the support piece 46 can slide freely to the left or right and can be secured in any position, on account of the longitudinal holes, by means of setting bolts. Consequently, the up and down movement of the piston 29 causes the piston 30 to move up and down by a force corresponding to the lever ratio, that is, the ratio of the distance between pin 42 and pin 45 to the distance between pin 42*a* and pin 45. Now, when the air pressure in the valve chamber 32 is referred to as P1 and the air pressure in the valve chamber 32*a* as P3, operating in such a manner that $P1 > P3$, then the piston 29 will rise according to the pressure difference $P1 - P3$ and the piston 30 will be pushed downward by a force proportional to the aforementioned lever ratio. Since the valve chamber 34 has a fixed pressure P2, the downwardly directed force applied to the piston 30 will be proportional to $P2 + K (P1 - P3)$. When this force overcomes the force urging the piston 30 upwardly due to the expansive force of the spring 37 and the force P4 applied at the bottom of the diaphragm 33*a*, the supply valve 38 will be separated from the valve seat 40 and compressed air supplied through the supply valve 17 will enter the chamber 48 and will be released through the outlet 18. A portion of this air flows to the valve chamber 34*a*, so that the diaphragm 33*a* is pushed upward in accordance with the pressure rise and the supply valve is closed in a state of balance with the aforesaid downwardly directed force being exerted on the piston 30. Thus, the output pressure is in accordance with the aforesaid equation $P4 = P2 + K (P1 - P3)$. Moreover, the relationship between the broken line indicating the pitch control pressure for the variable-pitch propeller and the solid line indicating the engine speed control pressure, as shown in the "control lever position/control force" diagram of FIG. 1, may vary in accordance with the change in the control pressure P3 in the valve chamber 32*a* or the control pressure p2 in the valve chamber 34. Thus, when the pressure P3 in the valve chamber 32*a* is raised only, the broken line can be positioned lower at a given angle of slope. When, likewise, the pressure P2 is raised only, the broken line can be moved upward.

We will now describe the operation of the entire compound remote control device comprising the aforementioned structural members.

When the control lever 6, shown in FIG. 3, is moved in the forward direction as indicated by the arrow (to the right), compressed air is released via the pressure-control valve 2 in accordance with the angle of rotation and flows to the engine speed governor 13. At the same time, a portion of the compressed air flows to the relay operator valve 14 and, after pressure transformation, the switch valve 8 being shifted to the open position, the air passes through it to the controller 26 for the variable-pitch device 25, putting same into the forward position. When the air pressure exceeds a fixed pressure, the pressure control valve 23 is actuated and the fixed pressure is maintained, control taking place as indicated by the lines on the right side of FIG. 1. When the control lever 6 is moved in the backward direction (to the left), the switch valve 8*a* is switched and the compressed air coming from the relay operator valve 14 flows, via the switch valve 8*a* and the pressure-control valve 24, to the controller 26 for the variable-pitch device 25, backward control taking place as indicated by the lines on the left side of FIG. 1.

In the practical embodiment as illustrated in FIG. 3, the output pressure of the pressure-control valve 2 is made the control pressure for the engine speed and the output pressure of the relay operator valve 14 is made the control pressure for the variable-pitch propeller. However, depending on the conditions for the "relationship" control, the output pressure of the pressure-control valve 2, transmitted via the switch valves 8 and 8*a*, can be made the control pressure for the variable-pitch propeller and the output pressure of the relay operator valve can be made the control pressure for the engine speed.

As illustrated by the above practical embodiment, in contradistinction to conventional device, the device of the present invention is provided with only one cam and control-valve set and so it is obvious that its structure is simpler. Also, on account of the regulation of the lever set position of the relay operator valve and the control of the pressures inside the valve chambers 32*a* and 34, the adjustment of the pitch of the variable-pitch propeller in relationship to the engine speed is rendered easy, while it is possible to obtain any kind of regulating combination.

Having now described the invention, what we claim as new and desire to secure by Letters Patent, is:

1. A compound remote control device having control devices for the control of engine speed and the pitch of a variable-pitch propeller by means of fluid signals, the fluid pressure being controlled in accordance with the position of a control lever, comprising, a fluid pressure source having a fixed pressure, a pressure-control valve receiving pressure from said source and transmitting a speed control pressure from an outlet in accordance with the position of said control lever, a relay operator valve for conversion of said control pressure into a propeller pitch control pressure, said relay operating valve comprising a first piston subject to pressures in first and second chamber of a first pair of opposing pressure chambers, a pressure reducing valve communicating said source to said first chamber, an inlet communicating said fixed pressure source to said second chamber, an exhaust port, a delivery port communicating said inlet port and said second chamber and said exhaust port to a propeller pitch control line, valve means operable in response to movement of said first piston in a direction opposing pressure in said first chamber to sever communication of said inlet port with said exhaust port, said second chamber and said delivery port, and open communication between said exhaust port, said second chamber and said delivery port, and operable in response to movement of said first piston in a direction opposing pressure in said second chamber to sever communication of said exhaust chamber with said inlet port, said second chamber and said delivery port, and, open communication between said inlet port, said second chamber and said delivery port, a second piston subject to pressure in a second pair of opposing pressure chambers, one of said second pair of opposing pressure chambers subjected to a predetermined pressure, the other of said second pair of opposing pressure chambers being communicated with said speed control pressure, and means interlinking said first and second pistons so that pressure in said other of said second pair of opposing pressure chambers adds to the pressure in said first chamber.

* * * * *